US005085789A

United States Patent [19]

Yokouchi et al.

[11] Patent Number: 5,085,789

[45] Date of Patent: Feb. 4, 1992

[54] FERROFLUID COMPOSITIONS

[75] Inventors: Atsushi Yokouchi, Yokohama; Toshikazu Yabe, Fujisawa, both of Japan

[73] Assignee: Nippon Seiko Kabushiki Kaisha, Tokyo, Japan

[21] Appl. No.: 515,353

[22] Filed: Apr. 30, 1990

Related U.S. Application Data

[63] Continuation-in-part of Ser. No. 226,794, Aug. 1, 1988, abandoned, which is a continuation-in-part of Ser. No. 163,795, Mar. 3, 1988, abandoned.

[30] Foreign Application Priority Data

Mar. 3, 1987 [JP] Japan ..... 62-48064
Feb. 19, 1988 [JP] Japan ..... 63-37029

[51] Int. Cl.[5] ..... H01F 1/28
[52] U.S. Cl. ..... 252/62.52; 252/62.51
[58] Field of Search ..... 252/62.51, 62.52, 62.53, 252/353

[56] References Cited

U.S. PATENT DOCUMENTS

| | | | |
|---|---|---|---|
| 4,013,569 | 3/1977 | Chiu et al. | 252/353 |
| 4,315,827 | 2/1982 | Bottenberg et al. | 252/62.52 |
| 4,599,184 | 7/1986 | Nakatani et al. | 252/62.52 |
| 4,701,276 | 10/1987 | Wyman | 252/62.52 |
| 4,753,754 | 6/1988 | Messenger et al. | 252/353 |

*Primary Examiner*—Michael Lewis
*Assistant Examiner*—Stephen G. Kalinchak
*Attorney, Agent, or Firm*—Weintraub, DuRoss & Brady

[57] ABSTRACT

A ferrofluid composition is defined by fine particles of ferromagnetic material, a liquid carrier for dispersing the ferromagnetic material and a surfactant or surfactants acting as a dispersant. The surfactant is required to have such relation to the carrier that the surfactant has, as its hydrophobic group portion, a structure equivalent to the carrier, and the carrier is selected to be either an alkylpolyphenyl ether oil, an alkylnaphthalene oil or both. By virtue of this structural feature, fine ferromagnetic particles are uniformly and stably dispersed throughout the carrier which has low viscosity and is thermally very stable.

3 Claims, No Drawings

FERROFLUID COMPOSITIONS

CROSS-REFERENCE TO RELATED APPLICATION

This application is a continuation-in-part application of U.S. patent application No. 226,794, filed Aug. 1, 1988, now abandoned, which in turn was a continuation-in-part of U.S. patent application Ser. No. 163,795, now abandoned, filed Mar. 3, 1988, for "Ferrofluid Compositions", the disclosure of which is hereby incorporated by reference.

BACKGROUND OF THE INVENTION

1. Field of the Invention

This invention relates to improved ferromagnetic fluid compositions commonly referred to as "ferrofluid compositions" in which fine particles of ferromagnetic material are dispersed in a very stable manner. More particularly, the present invention relates to ferrofluid compositions having low vapor pressure and low viscosity and which are suitable for use in seals under vacuum.

2. Prior Art

As conventional ferrofluids for a vacuum seal, there have been proposed two types of ferrofluids. One utilizes polyphenyl ether oil as its liquid carrier for dispersing therein the ferromagnetic particles, as disclosed by U.S. Pat. No. 4,315,827, and the other one utilizes alkylnaphthalene oil as disclosed by Japanese Laid-open (unexamined) Patent Publication No. Sho 59(1984)-168097.

Although the ferrofluid of the former is suitable for ultra low vacuum seals, due to its polyphenyl ether oil as a liquid carrier, having a very low vapor pressure of less than $10^{-7}$ torr, it, adversely, has high viscosity, since the viscosity of polyphenyl ether oil is 120 cst at 40° C. This brings about high torque when the ferrofluid is used for a rotary shaft, and, thus, results in frictional heat within the ferrofluid itself, or at the peripheral machine parts or components to which the former ferrofluid is applied, thereby degrading the sealing power of the related machine parts.

On the other hand, as the latter utilizes alkylnaphthalene oil as its carrier, there exists no problem with respect to the viscosity. However, there arise other problems as explained below due to the fact that it uses petroleum sulfonic acid as a surfactant for dispersing fine ferromagnetic particles throughout the carrier.

More particularly, petroleum sulfonic acid has various portions of hydrophobic groups, among which there are contained some components which have poor affinity with the alkylnaphthalene oil carrier. Fine particles of ferromagnetic material which have adsorbed these components having poor affinity, naturally become poor in dispersion property and are liable to precipitate or settle within the carrier, thereby decreasing the yield in producing the same, and, further, it becomes impossible to obtain a ferrofluid in high concentration.

SUMMARY OF THE INVENTION

The present invention has been developed so as to obviate the above-mentioned drawbacks. The present invention has solved the aforesaid problems by providing ferrofluid compositions comprising fine particles of ferromagnetic materials being dispersed in a carrier selected from the group consisting essentially of alkylpolyphenyl ether oil and alkyl-naphthalene oil through the use of a surfactant having equivalent structure as its hydrophobic group portion.

Since the present invention uses as a carrier, for dispersing the ferromagnetic particles, either an alkylpolyphenyl ether oil or an alkylnaphthalene oil or both, having low viscosity, the ferrofluid, thus obtained, can satisfactorily suppress the frictional heat which is apt to be generated at the rotary shaft, during its rotation.

The viscosity of the subject ferrofluid can be adjusted, depending on the condition of the intended use, by admixing the above-mentioned two carriers in a suitable ratio and manner.

In addition, since the surfactant or surfactants used as a dispersing agent in accordance with the present invention comprise, at their hydrophobic group portion, chemical structure equivalent to that of the carrier, the surfactant or surfactants are able to have a high extent of chemical affinity with the carrier to be used in cooperation therewith, and thereby the dispersion property of the fine particles of the ferromagnetic material can be greatly stabilized.

DETAILED DESCRIPTION OF THE PREFERRED EMBODIMENTS

The carriers in accordance with the present invention are comprised of synthetic oils having low viscosity, low vapor pressure and low pour point. Specifically, either an alkylpolyphenyl ether oil or an alkylnaphthalene oil or mixtures thereof, as shown in Table 1 are suitably used.

TABLE I

| Synthetic Oil | Viscosity cst at 40° C. torr | Vapor Pressure | Pour Point C° C. |
|---|---|---|---|
| Octadecyldiphenyl ether (AP) | 25 | $1 \times 10^{-6}$ | −40.0 |
| Hexadecyltriphenyl ether (AP) | 60 | $1 \times 10^{-6}$ | −32.5 |
| Eicocylnaphthalene (AN) | 38 | less than $5 \times 10^{-9}$ | less than −5 |
| Tetraphenyl Ether (PE) | 120 | $3 \times 10^{-9}$ | 2.5 |
| Pentaphenyl Ether (PE) | 280 | $1 \times 10^{-11}$ | 2.5 |

In the Table, symbol (AP) denotes alkylpolyphenyl ether oil and symbol (AN) denotes alkylnaphthalene oil, respectively, while (PE) denotes polyphenyl ether oil shown for reference.

The introduction of an alkyl group into the hydrophobic group in the carrier fluid causes the viscosity and vapor pressure of the carrier fluid to decrease. Alkyl groups usable for attachment to the hydrophobic group of the carrier fluid are preferably those containing at least 12 carbons. Alkyl groups having between 12 and 20 carbons are particularly preferred.

The addition of the alkyl group to the carrier fluid brings the vapor pressure thereof below $10^{-4}$ torr (at room temperature). The addition of the alkyl group also lowers the viscosity to a value below 80 cst at 40° C. Therefore the advantage of adding the alkyl group to the carrier fluid molecule is the benefit of lowered viscosity and lowered volatility.

In accordance with the present invention, either the listed alkylpolyphenyl ether oils or the alkylnaphthalene oil or a mixture of the two synthetic oils are used as a carrier, depending upon the intended use for the ferrofluid composition of this invention.

The surfactant or surfactants used in the present invention has in its structure both a nonpolar hydrophobic group portion and a polar hydrophilic group portion, one such among them having at its hydrophobic group portion a structure or structures equivalent to the carrier listed above.

In other words, in the case where an alkylpolyphenyl ether is selected as a carrier, a suitable dispersing agent can be one of the materials having an alkylpolyphenyl structure, such as a sodium salt of sulfonated octadecyldiphenyl ether, while when alkylnaphthalene is used as a carrier, a material(s) having an alkylnaphthalene structure, such as a sodium salt of sulfonated eicocylnaphthalene, is preferred to be used as a suitable dispersant.

In such cases where a mixture of alkylpolyphenyl ether oil and alkylnaphthalene oil is selected as a carrier, the surfactant to be suitably used is, also, a mixture of materials, each having a hydrophobic structure of the respective carrier component.

As to the hydrophilic group portion of the surfactant, it is required to render the molecule of the surfactant to be firmly adsorbed onto the surface of a ferromagnetic particle.

This can be accomplished by selecting such surfactant or surfactants that have, depending on the surface electric charge of the fine ferromagnetic particles, at least one such hydrophilic group that can be electrically bonded to ferromagnetic particles, for instance, acids, bases or the salt of a sulfonic group, sulfate ester group, phosphate ester group, carboxyl group, alcohol group, amino group or the like.

Ferromagnetic particles suitable for the present invention can be of such ones obtained as a colloidal suspension by the well-known wet method. Alternatively, they can be prepared by a so-called wet pulverizing technique, wherein magnetite particles are pulverized by a ball mill in water or in an organic solvent or by other methods such as a dry method.

It is also possible to use ferromagnetic particles other than magnetite, for example, manganese ferrite, nickel ferrite, cobalt ferrite, a composite ferrite of these ferrites with zinc, barium ferrite and the like. Alternatively, fine particles of metal such as iron or cobalt also can be used.

EXAMPLE I 6N of NaOH solution was added to 1 l of an aqueous solution containing 0.3 mol each of ferrous sulfate and ferric sulfate until the pH of the solution reached 11. Then the solution was aged at 60° C. for 30 minutes. Thus, there was obtained a slurry of a magnetite colloid. Next, the slurry was washed with water at room temperature and the remaining electrolyte was completely removed from the slurry. This is a process step for making fine magnetite particles by a wet method.

Thereafter, 14 grams of the sodium salt of sulfonated octadecyldiphenylether shown below was added, as a surfactant, to the thus obtained magnetite slurry.

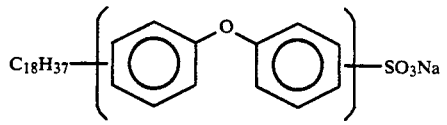

Then an aqueous solution of 3N HCl was added to the slurry to adjust the pH of the slurry to 3 and, further, the slurry was agitated for 30 minutes at 60° C., thereby rendering the surfactant adsorbable on the surface of the fine magnetite particles. The slurry, thus treated, was held still so that the fine magnetite particles could be coagulated and settled, while the supernatant was poured out. Then a suitable amount of water was added and the slurry was agitated, again, then held still and the supernatant was poured out. Then a suitable amount of water was added and the slurry was agitated, again, then held still and the supernatant was poured out. Such water washing operations were repeated several times until the electrolyte in the solution was completely removed. Then the solution was filtered, and the magnetite was dehydrated and dried to obtain magnetite particles of desired size and properties.

Then a suitable amount of hexane was added to the magnetite particles with sufficient agitation so as to let the magnetite particles be dispersed in the hexane. The colloidal solution so obtained was transferred to a centrifugal separator for separating magnetite particles of unacceptable larger diameter under a centrifugal force of 8,000 G for 30 minutes. Fifteen grams of octadecyldiphenylether oil as a carrier, namely, a dispersing medium, expressed by the chemical formula shown below:

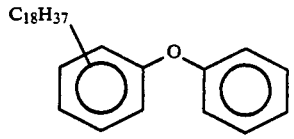

was added to the colloidal solution obtained by the centrifugal separation explained above and was sufficiently admixed. Then the admixture was transferred to a rotary evaporator and held there at 90° C. so as to remove any remaining hexane, by evaporation.

The colloidal solution, after having gone through the evaporation step, was subjected to centrifugal separation for 30 minutes under a centrifugal force of 5,000 G. Thereby the undispersed solid particles were completely removed and the obtained ferrofluid was proven to be very stable showing saturation magnetization of about 180 Gauss.

EXAMPLE II

A magnetite slurry was obtained by the wet-method similar to that used for Example I. Then the slurry was filtered, degassed and dried at 70° C. to obtain magnetite powders. Then 1.5 grams of sodium salt of sulfonated hexadecyltetraphenyl ether, as a surfactant, as expressed by the chemical formula shown below:

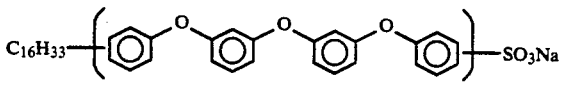

and a suitable amount of hexane were added to 5 grams of the magnetite powders and the admixture was ground and pulverized for 2 hours by using a ball mill.

Next, the thus treated mixture was transferred to a centrifugal separator, where the mixture was subjected to separation for 30 minutes under a centrifugal force of 8,000 G, thereby removing magnetite particles of larger particle diameter. Thereafter 5 grams of octadecyldiphenyl ether, as a carrier, was added to the mixture and was fully admixed. The resultant ferrofluid proved to be very stable and similar to that obtained in Example I.

EXAMPLE III

A very stable ferrofluid was obtained by using 15 grams of eicocylnaphthalene as a carrier, expressed by the chemical formula shown below:

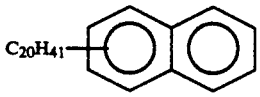

together with 25 grams of sodium salt of sulfonated eicocylnaphthalene as a surfactant acting as a dispersing agent expressed by the chemical formula shown below:

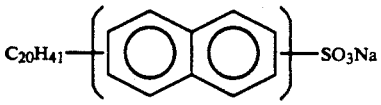

and by treating the admixture of these components in a similar way as that applied to Example I.

EXAMPLE IV

A very stable ferrofluid was obtained by applying the same treatment as adopted in Example II and by using 5 grams of a carrier of eicocylnaphthalene and 2.25 grams of a sulfonated eicocylnaphthalene as a dispersing agent expressed by the chemical formula as follows:

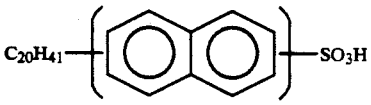

EXAMPLE V

A comparison test was conducted to evaluate the difference between the lifetime of the ferrofluid compositions of the present invention and that of the prior art by using the test method explained below.

A ferrofluid composition of the prior art was prepared by using 5 grams of eicocylnaphthalene as a carrier and 2.25 grams of sodium salt of petroleum sulfonic acid by treating the admixture in the same manner as in Example II.

10 μl each of the two kinds of ferrofluids obtained by Example IV and that of prior art type, as explained above, were taken up and fixed on a slide glass placed on a sintered magnet piece, respectively. These samples were heated at 100° C. to observe the period of time until each sample had solidified or become viscous, which indicates thermal stability, namely, the life time of the two ferrofluid samples under comparison.

As the result, a clear difference was revealed between the two ferrofluids as can be seen from the following Table.

| Test Item | Ferrofluid of Example IV | Prior Art ferrofluid |
|---|---|---|
| Saturation Magnetization | 180 Gauss | 180 Gauss |
| Solidifying Time | No sign of solidification nor increased viscosity was observed even after 3000 hours. | 825 hours |

Having, thus described the invention, what is claimed is:

1. A ferrofluid composition consisting essentially of:
(a) fine particles of ferromagnetic material;
(b) a liquid carrier which comprises an alkylnaphthalene;
(c) a surfactant consisting of a direct combination of a hydrophilic portion and a hydrophobic portion, the hydrophobic portion consisting of an alkylnaphthalene structure "substantially identical to the alkylnaphthalene structure of said liquid carrier".

2. A ferrofluid composition as claimed in claim 1, wherein said liquid carrier is eicocylnaphthalene and said surfactant is a sodium salt of sulfonated eicocylnaphthalene.

3. A ferrofluid composition as claimed in claim 1, wherein said liquid carrier is eicocylnaphthalene and said surfactant is eicocylnaphthalene sulfonic acid.

* * * * *